US009883726B2

(12) United States Patent
Hsu

(10) Patent No.: US 9,883,726 B2
(45) Date of Patent: Feb. 6, 2018

(54) HAIR DRYER WITH IMPROVED OUTLET UNIT

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 0 days.

(21) Appl. No.: 14/975,839

(22) Filed: Dec. 20, 2015

(65) Prior Publication Data

US 2017/0172276 A1 Jun. 22, 2017

(51) Int. Cl.
*A45D 20/12* (2006.01)

(52) U.S. Cl.
CPC ..... *A45D 20/12* (2013.01)

(58) Field of Classification Search
CPC ... F26B 3/00; F26B 3/08; A45D 20/00; A45D 20/12
USPC ..... 34/97, 96, 98–100
See application file for complete search history.

(56) References Cited

U.S. PATENT DOCUMENTS 5,054,211 A * 10/1991 Shulman ..... A45D 20/124 239/581.1
5,161,317 A * 11/1992 McDougall ..... A45D 20/124 239/383
5,555,637 A * 9/1996 Montagnino ..... A45D 20/10 34/97
5,626,156 A * 5/1997 Vicory, Sr. ..... A45D 2/10 132/229
5,642,570 A * 7/1997 Lee ..... A45D 19/16 34/98
5,720,107 A * 2/1998 Rolf ..... A45D 20/124 34/97
5,727,331 A * 3/1998 Thaler ..... A45D 20/12 34/97
5,857,262 A * 1/1999 Bonnema ..... A45D 20/06 126/409
5,857,263 A * 1/1999 Chan ..... A45D 20/12 34/97
6,003,239 A * 12/1999 Liebenthal ..... A45D 20/12 34/97
6,026,590 A * 2/2000 Picozza ..... A45D 20/16 34/90
6,148,537 A * 11/2000 Altamore ..... A45D 20/10 34/97
7,204,038 B2 * 4/2007 Santhouse ..... A45D 20/12 132/116
8,302,324 B1 * 11/2012 Connelly ..... A45D 20/12 132/118
8,434,238 B2 * 5/2013 Gross ..... A45D 20/12 132/212
9,241,556 B2 * 1/2016 Lee ..... A45D 20/12
9,474,347 B2 * 10/2016 Pedroarena ..... A45D 20/12
9,498,039 B2 * 11/2016 Matsui ..... H01T 23/00
(Continued)

FOREIGN PATENT DOCUMENTS

KR 200463385 Y1 * 11/2012 ..... A45D 20/12

*Primary Examiner* — Stephen M Gravini
(74) *Attorney, Agent, or Firm* — Alan D. Kamrath; Kamrath IP Lawfirm, P.A.

(57) ABSTRACT

A hair dryer includes a main body and an outlet unit. The outlet unit is provided therein with an air-guiding member, which can convert a linearly ongoing air current into a rotationally ongoing air current. Furthermore, the outlet define a plurality of air holes, through which outside air can be drawn into the outlet unit to mix with the air current flowing out of the exit of the main body, to increase air speed, uniformity and penetration and to reduce noise.

9 Claims, 10 Drawing Sheets

(56) References Cited

U.S. PATENT DOCUMENTS

| | | | | |
|---|---|---|---|---|
| 2012/0102775 | A1* | 5/2012 | Choi | A45D 20/12 34/98 |
| 2012/0260516 | A1* | 10/2012 | Han | A45D 20/124 34/97 |
| 2013/0014402 | A1* | 1/2013 | Han | A45D 20/124 34/97 |

* cited by examiner

HAIR DRYER WITH IMPROVED OUTLET UNIT

(a) Technical Field of the Invention

The present invention relates to a hair dryer and, more particularly, to a hair dryer with an improved outlet unit. The outlet unit is provided therein with an air-guiding member which can convert a linearly ongoing air current into a rotationally ongoing air current, to increase air speed, uniformity and penetration and to reduce noise.

(b) Description of the Prior Art

Hair dryers, which are commonly used at home, have a simple structure. Typically, a hair dryer is provided therein with a fan unit and a heating unit. In use, the fan unit can draw outside air into its housing to generate an ongoing air current, which is then heated by the heating unit and which finally goes out of an exit which is generally a circular opening for delivering a large amount of air. However, the intensity of the air current provided by this type of hair dryer is somewhat weak. To alleviate this defect, an outlet unit having a straight channel for a hair dryer is provided, which allows the ongoing air current to move in a unique direction towards an object. In combing hair, the ongoing air current can only enter the top of the hair structure of a user, but is unable to enter the bottom of the hair structure. Therefore, the top of the hair structure of the user will become dry and hot, while the bottom of the hair structure still remains wet.

In view of the foregoing, the present invention provides a hair dryer with an improved outlet unit for solving the shortcomings of conventional hair dryers.

SUMMARY OF THE INVENTION

One object of the present invention is to provide a hair dryer having an outlet unit at the exit of the main body of the hair dryer. The outlet unit is provided thereinwith an air-guiding member, which can convert a linearly ongoing air current into a rotationally ongoing air current, to increase air speed and penetration and to reduce noise.

According to one feature of the present invention, the outlet unit defines a plurality of air holes through which outside air can be drawn into the outlet unit to mix with the air current flowing out of the exit of the main body, to provide a uniform air current for a user.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
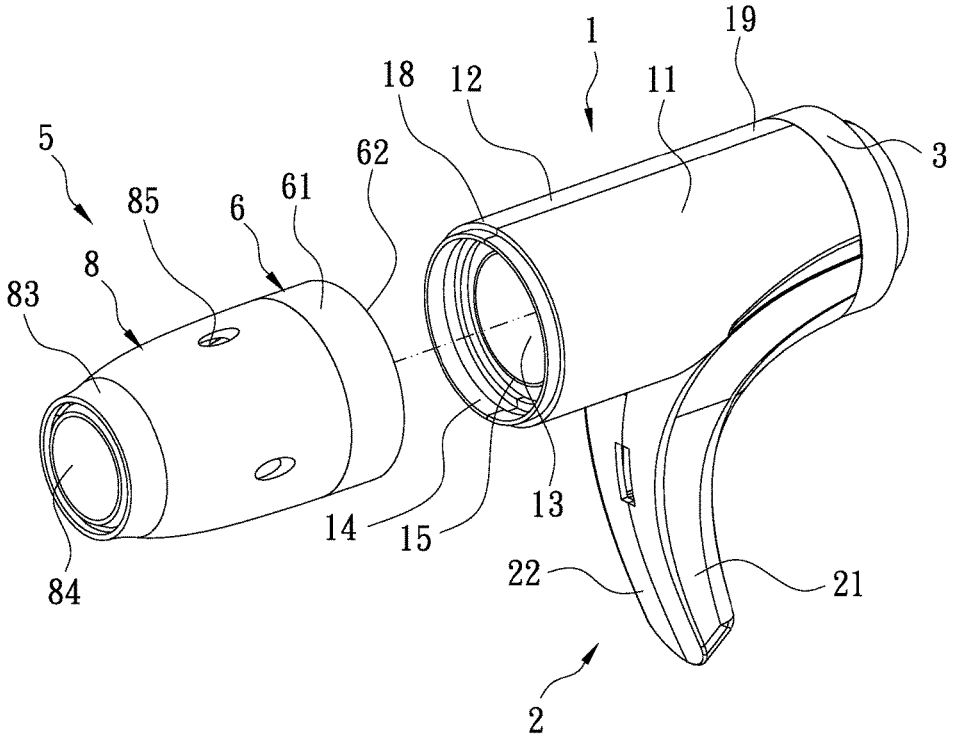
FIG. 1 shows an exploded view of a hair dryer with an outlet unit according to one embodiment of the present invention.
Figure 2:
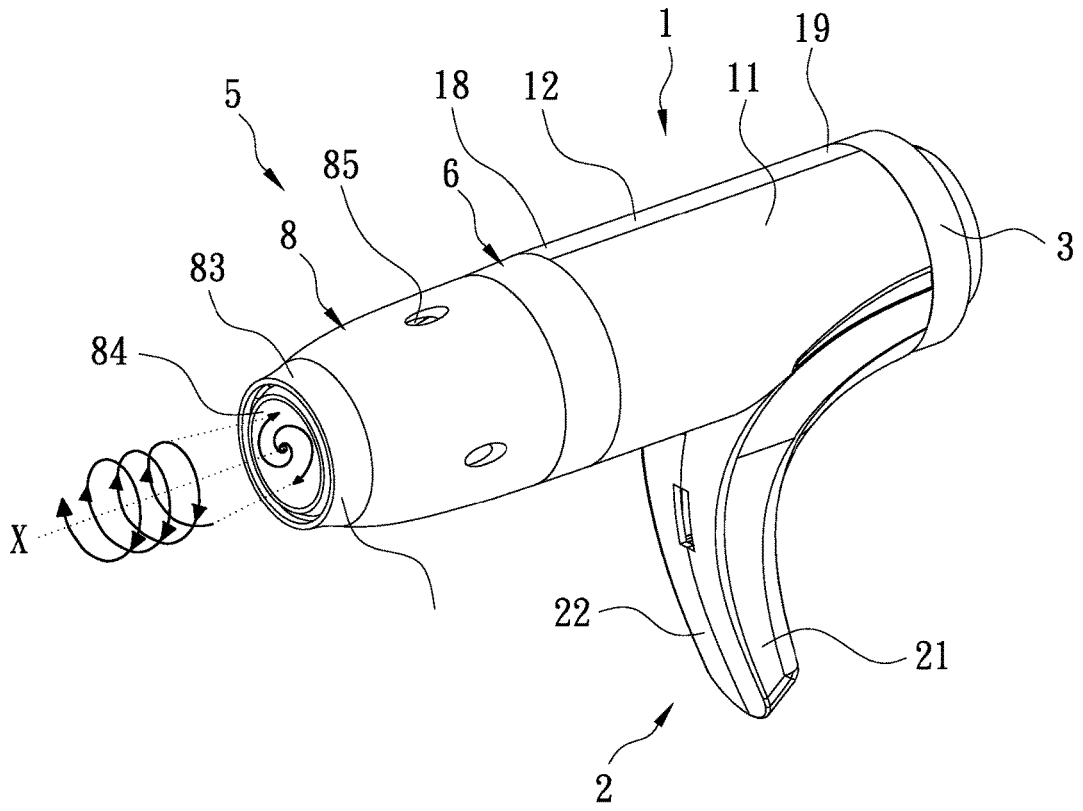
FIG. 2 shows a 3-dimensional view of the hair dryer.

Referring to FIGS. 1 through 4, a hair dryer according to one embodiment of the present invention is shown, which generally comprises a main body 1 and an outlet unit 5. The main body 1 is essentially composed of a left shell 11, a right shell 12, and an inner case 15 sandwiched between the left shell 11 and the right shell 12. The inner case 15 defines therein an inner space 10, which has a circular cross section, for installing a fan unit 16 and a heating unit 17. The fan unit 16 can draw outside air into the inner case 15 to generate an air current 91, which is originally cold air. The heating unit 17 can heat up the cold air current generated by the fan unit 16 to form a linearly ongoing current of hot air flowing out of an exit 13 of the main body 1. Since the fan unit 16 and the heating unit 17 are commonly used elements in hair dryers, they are shown only by blocks in FIG. 3. After combining the left and right shells 11, 12, the main body 1 forms a connection portion 14 at its front end 18, which defines the exit 13. A rear cap 3, with air holes (not shown), is provided at the rear end 19 of the main body 1. The main body 1 is provided, between the front end 18 and the rear end 19, with a handle 2, which is composed of a left part 21 and a right part 22. One primary feature of the present invention is that the main body 1 is provided with the outlet unit 5 at its exit 13, so that the linearly ongoing current of hot air can be converted into a rotationally ongoing current of hot air. In addition, the outlet unit 5 allows the air current 91, which has been heated by the heating unit 17, to mix with a downstream cold air current 90 (cold air) from the ambient environment. As such, the hair dryer can increase air speed, penetration and uniformity, and can reduce noise. In tidying hair, since the airflow provided by the hair dryer of the present invention, which is a rotationally ongoing air current rather than a linearly ongoing air current, can penetrate the top of the hair structure of a user to reach the bottom of the hair structure more easily, the user's hair can be quickly dried. Furthermore, the air current 91, which is heated and mixed with the downstream cold air current 90 drawn from the ambient environment, can obtain an air flow of warm temperature suitable for a user, which is not like the airflow provided by conventional hair dryers, which is both hot and dry.

Figure 3:
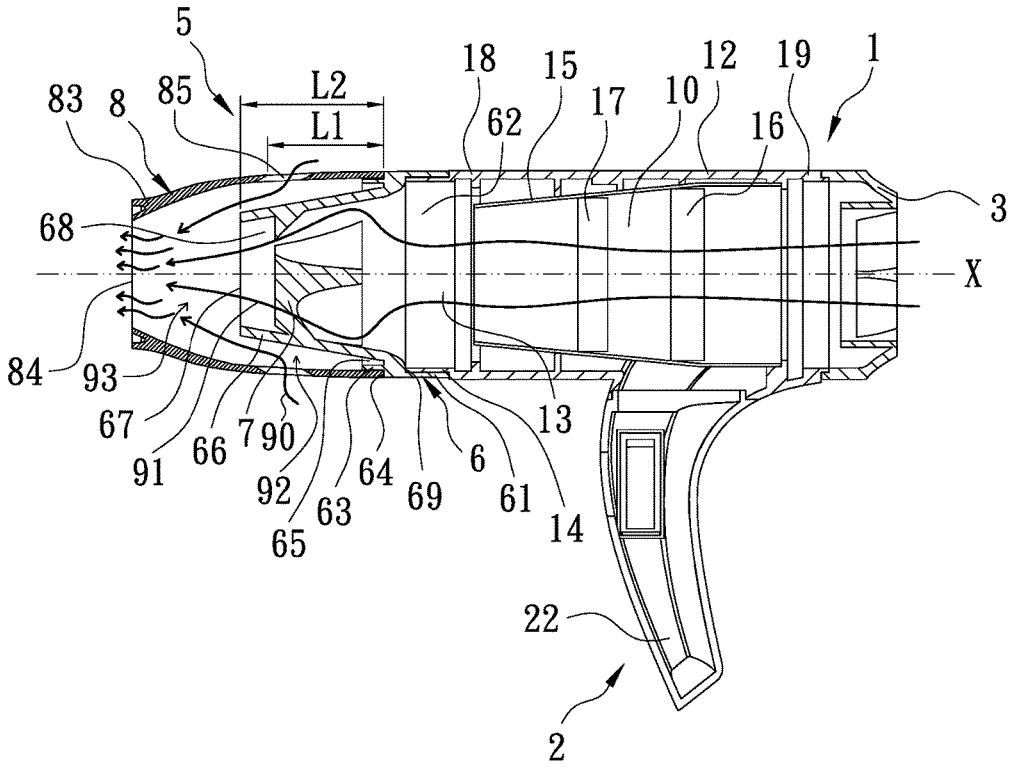
FIG. 3 shows a sectional view of the hair dryer.
Figure 4:
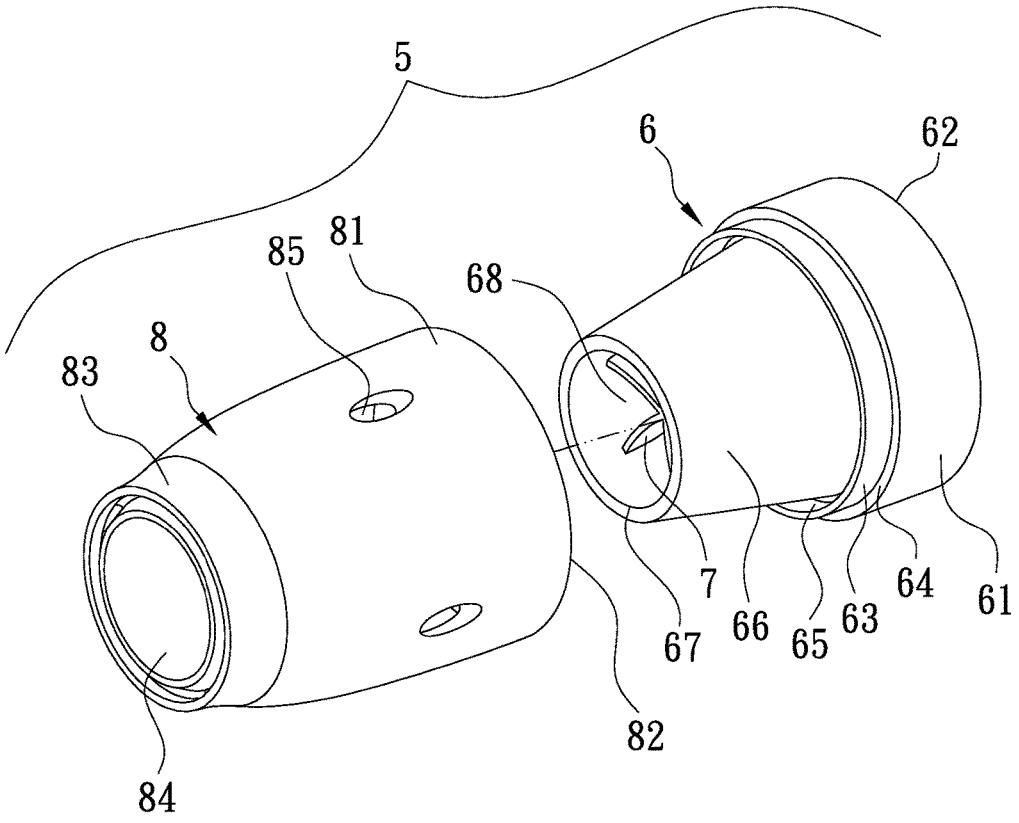
FIG. 4 shows an exploded view of a first embodiment of the outlet unit, which is composed of a rear housing and a front housing.
Figure 5:
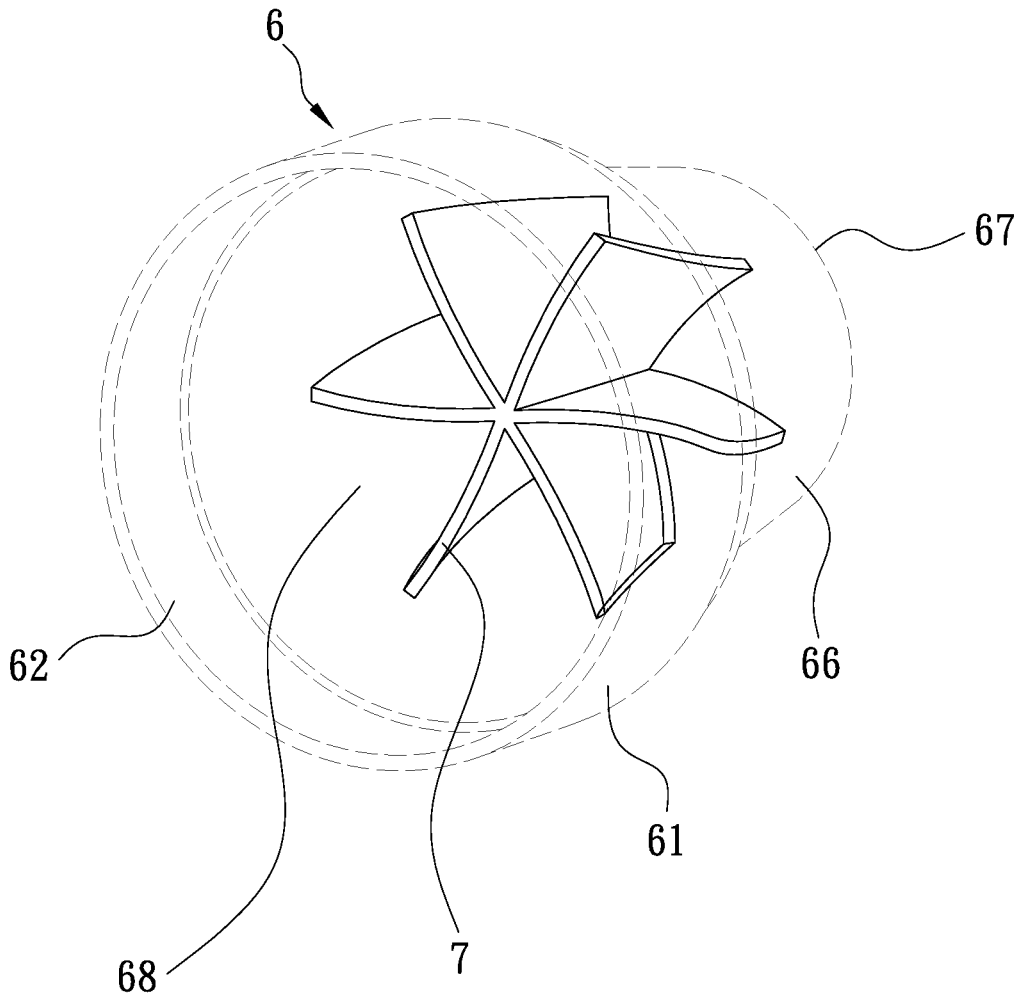
FIG. 5 shows a 3-dimensional view of the rear housing of the first embodiment of the outlet unit.
Figure 6:
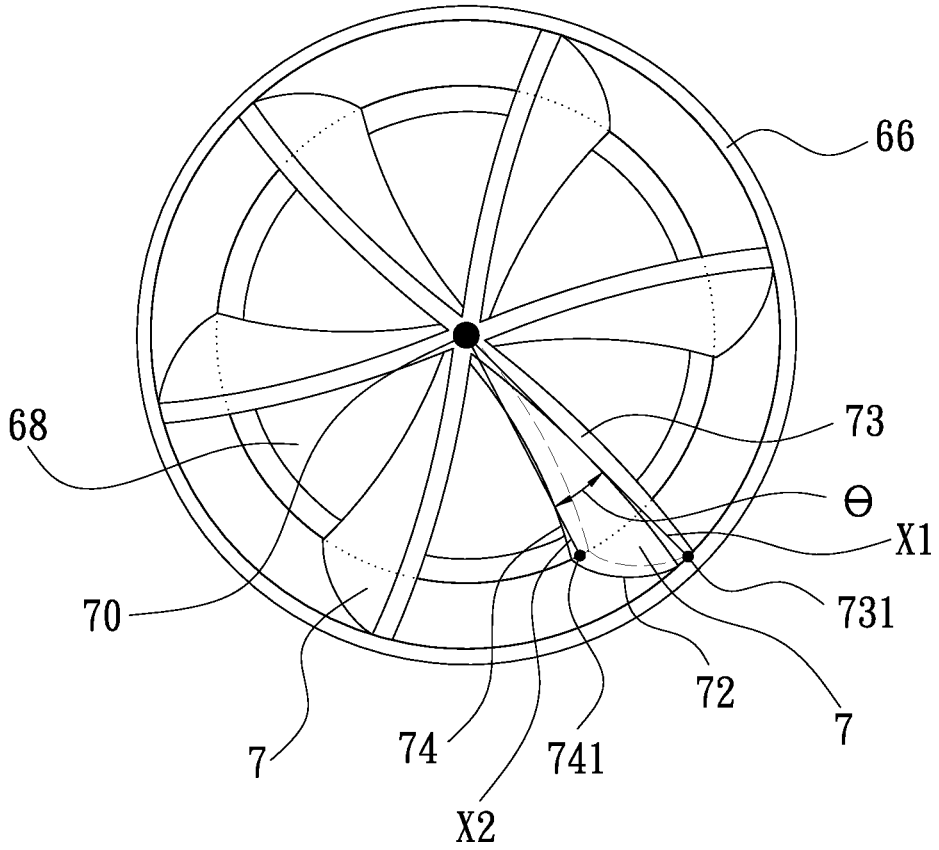
FIG. 6 shows a plan view of the rear housing of the first embodiment of the outlet unit.

In a first embodiment, the outlet unit 5 is composed of a rear housing 6 and a front housing 8. As shown in FIGS. 4 and 5, the rear housing 6 has a round portion 61 and a conical shell 66. The round portion 61 defines an entrance 62 at its rear end and is formed with an inwardly annular wall 69 at its front end (see FIG. 3). The conical shell 66 extends from an inner edge of the inwardly annular wall 69 of the round portion 61 and defines an exit 67 at its front end. The conical shell 66 is gradually reduced in its cross section as it extends towards its front end. The inwardly annular wall 69 is provided with an annular projection 63 around the conical shell 66, and the external diameter of the annular projection 63 is less than that of the round portion 61, such that an annular surface 64 is formed to and around the annular projection 63. A first annular space 65 is defined between the annular projection 63 and the conical shell 66. The rear housing 6 defines therein an inner space 68. The inwardly annular wall 69 is located between the round portion 61 and the conical shell 66. The rear housing 6 can be connected to the main body 1 by its round portion 61 snugly fitting over the connection portion 14 of the main body 1. Namely, the connection portion 14 of the main body 1 is inserted into the entrance 62 of the round portion 61, and the connection portion 14 of the main body 1 abuts the inwardly annular wall 69 of the rear housing 6. An air-guiding member 7 is provided at the inner space 68 of the rear housing 6. The air-guiding member 7 has a number of blades which extend outwardly from a central common axis 70 to the conical shell 66. Each blade has a lateral edge 72 which joins with the conical shell 66. Each blade has a front edge 74 facing towards the exit 67 of the rear housing 6 and has a rear edge 73 opposite to the front edge 74 (i.e., the rear edge 73 facing towards the exit 13 of the main body 1). The central common axis 70 of the air-guiding member 7 is coaxial with a central axis (X) of the inner case 15 sandwiched between the left and right shells 11, 12 of the main body 1. The lateral edge 72 and the rear edge 73 of each blade of the air-guiding member 7 intersect at a first point 731, while the lateral edge 72 and the front edge 74 of each blade of the air-guiding member 7 intersect at a second point 741. A first line (X1) is connected between the first point 731 and the central common axis 70, such that the firstline X1 has a shortest distance between the first point 731 and the central common axis 70. Namely, the first line (X1) is perpendicular to the central common axis 70. A second line (X2) is connected between the second point 741 and the central common axis 70 such that the second line (X2) has a shortest distance between the second point 741 and the central common axis 70. Namely, the second line (X2) is perpendicular to the central common axis 70. The length of the first line (X1 ) is greater than the length of the second line (X2). As such, the central common axis 70 and the lateral edge 72 of each blade of the air-guiding member 7 define a twisted surface therebetween. Furthermore, the first line (X1) and the second line (X2) are offset by an angle (Θ) as they are viewed in the direction of the central common axis 70. Namely, the front edge 74 are generally twisted from the rear edge 73 by an angle (Θ).

Figure 7:
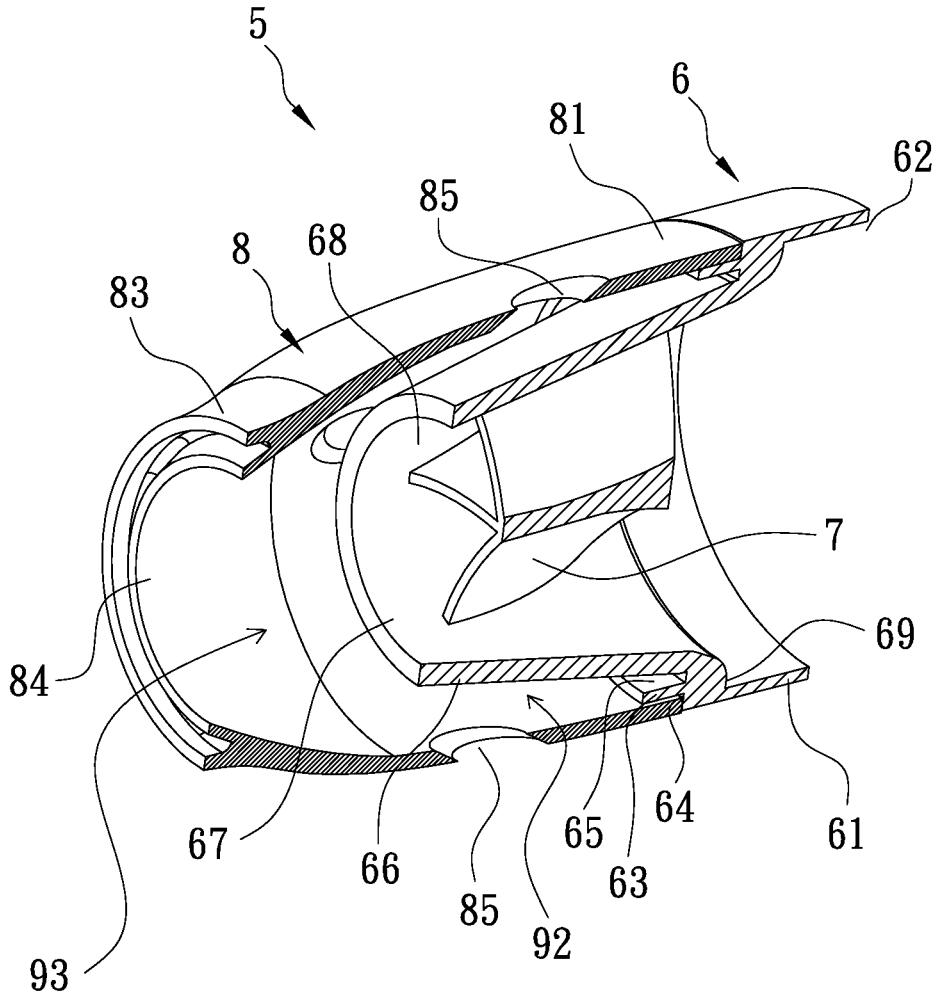
FIG. 7 shows a 3-dimensionally sectional view of the first embodiment of the outlet unit.

The front housing 8 has a connection portion 81 at its rear end and defines an exit 84 at its front end 83 and defines a plurality of air holes 85 at its circumferential wall. The connection portion 81 of the front housing 8 defines an opening 82, and the front housing 8 is gradually reduced in its cross section as it extends from its rear end to its front end. The front housing 8, which is greater than the conical shell 66 in diameter, can be fitted around the conical shell 66 of the rear housing 6 to have its connection portion 81 snugly fit over the annular projection 63 of the rear housing 6 and abut the annular surface 64 of the rear housing 6. As shown in FIG. 3, the maximum distance between the air holes 85 and the opening 82 defined at the rear end of the front housing 8 is indicated by (L1). The distance between the exit 67 of the rear housing 6 and the annular surface 64 of the rear housing 6 is indicated by (L2), which is also the distance between the exit 67 and the opening 82 after the front housing 8 is connected to the rear housing 6, with distance (L2) being greater than distance (L1). The diameter of the rear housing 6 is less than that of the front housing 8, thus defining a second annular space 92 therebetween (see FIGS. 3 and 7). As shown, the downstream air current 90 can be drawn into the second annular space 92 via the air holes 85. The downstream cold air current 90 from the ambient environment can go past the front end of the conical shell 66 of the rear housing 6 to move towards the exit 84 of the front housing 8. As shown in FIGS. 3 and 7. The space between the exit 67 of the rear housing 6 and the exit 84 of the fronthousing 8 can work as an air mixing zone 93, in which the air current 91 which has been heated can mix with the downstream cold air current 90, to obtain a warm flow, which is less hot than the air current 91 which has been heated, so that the air current provided by the hair dryer is more comfortable for a user. Furthermore, the twisted blades of the air-guiding member 7 can convert the linearly ongoing air current 91 to a rotationally ongoing air current flowing out of the exit 84 of the front housing 8 (see FIGS. 2 and 3), so that the air current provided by the hair dryer can penetrate the hair structure of a user more easily to facilitate the user in tidying and drying hair.

Figure 8:
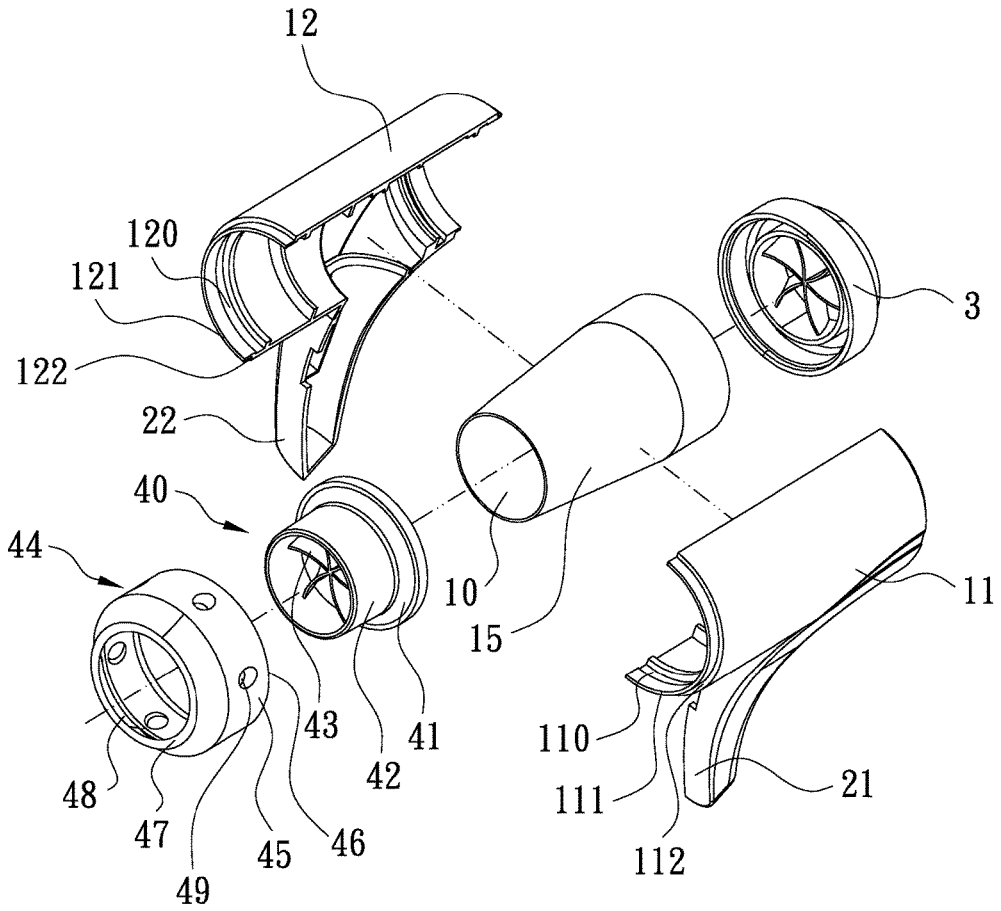
FIG. 8 shows an exploded view of a second embodiment of the outlet unit.
Figure 9:
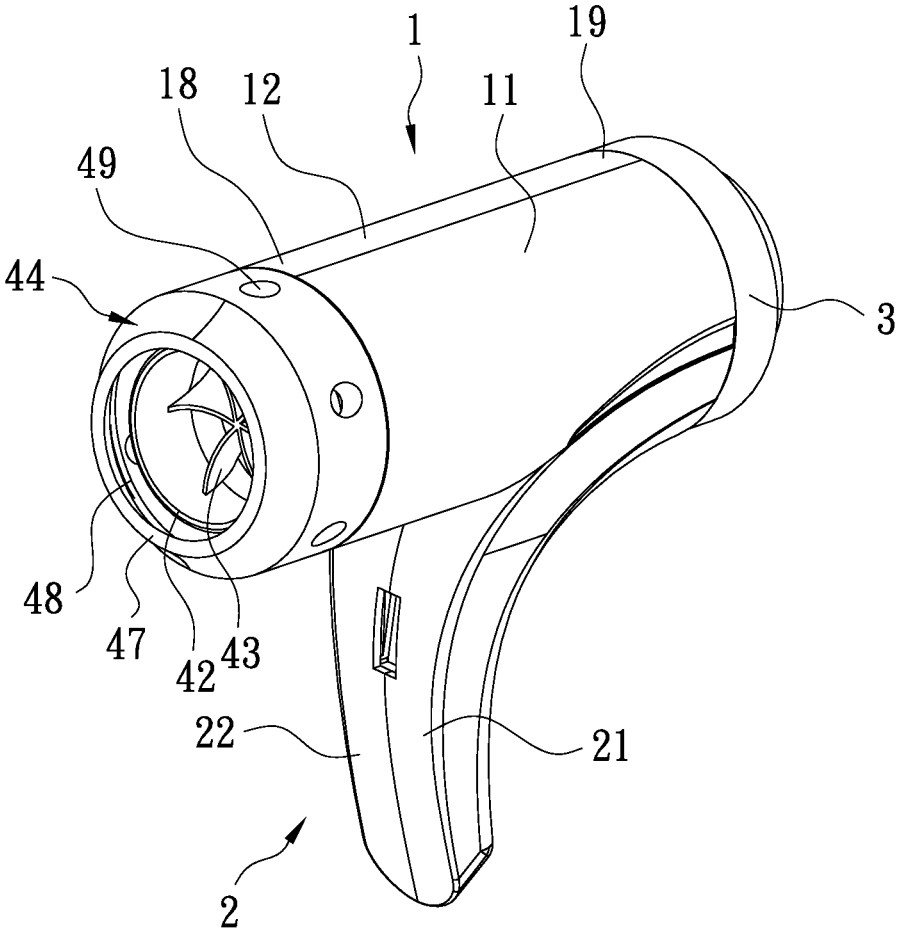
FIG. 9 shows a 3-dimensional view of the second embodiment of the outlet unit.
Figure 10:
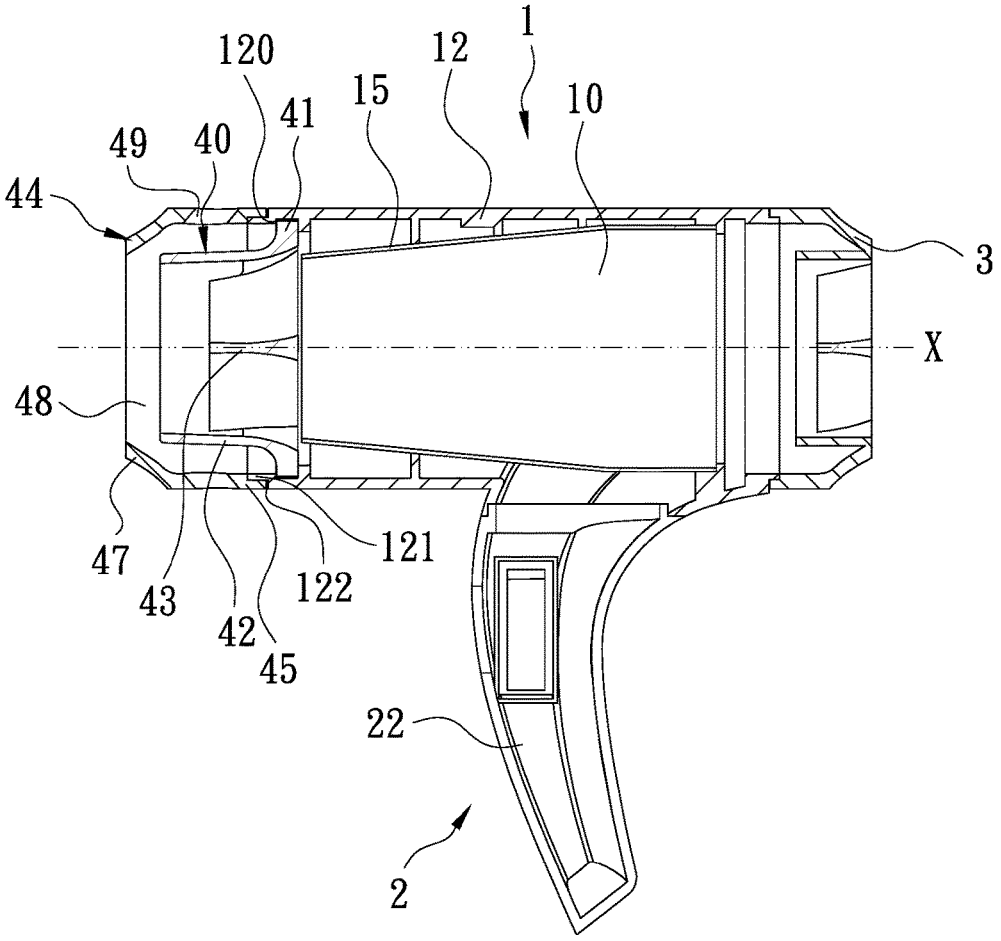
FIG. 10 shows a sectional view of the second embodiment of the outlet unit.

FIGS. 8, 9 and 10 show a second embodiment of the outlet unit of the present invention. The rear housing 40 has a round portion 41 and a conical shell 42 extending from the round portion 41 and is provided with an air-guiding member 43 having a number of twisted blades within the conical shell 42. The left and right shells 11, 12 of the main body 1 respectively define semicircular recesses 110, 120 at their inner surfaces, near the front end 18 of the main body 1. The left and right shells 11, 12 of the main body 1 are respectively provided, at the front end 18 of the main body 1, with semicircular projections 111, 121, which have an external diameter less than the circumferential wall of the main body 1, thereby respectively forming steps 112, 122 around the semicircular projections 111, 121. The round portion 41 of the rear housing 40 can be fitted into the semicircular recesses 110, 120, so that the rear housing 40 can be connected to the main body 1. The front housing 44 is different from the front housing 8 in shape. However, both housings of the two embodiments generally have the same structural features. The front housing 44 has a connection portion 45 defining an opening 46 at its rear end and defines an exit 48 at its front end 47. As similar to the first embodiment, the front housing 44 defines a plurality of air holes 49, through which outside air can be drawn into theinterior of the front housing 44. The front housing 44 can be snugly fit over the semicircular projections 111, 121 of the left and right shells 11, 12 of the main body 1 to be in contact with the steps 112, 122 of the left and right shells 11, 12 of the main body 1.

As a summary, the outlet unit 5 of the present invention can increase air speed, uniformity and penetration, and can reduce noise. Since the air output provided by the present invention is a rotationally ongoing air current rather than a linearly ongoing air current or in other words, since the air current flowing out the outlet unit 5 can rotationally advance, it can penetrate the top of the hair structure of a user to enter the bottom of the hair structure more easily, the user's hair can be quickly dried. Additionally, the air current 91 which is heated can mix with the downstream, cold air current from the ambient environment, so that the air output of the present invention will not tend to be both dry and hot. The less hot air current provided by the present invention will be more suitable for a user.

I claim:

1. A hair dryer having a main body which includes:

a fan unit;

a heating unit, with the fan unit capable of generating an air current which passes through the heating unit in front thereof to form a linearly ongoing current of hot air flowing out of a body exit; and an outlet unit extending from the body exit to a housing exit, with the outlet unit including a circumferential wall, with an air-guiding member within the circumferential wall to receive the linearly ongoing current of hot air from the body exit, and with a plurality of air holes defined in the circumferential wall, located intermediate and spaced from the body and housing exits and radially outward of the air-guiding member, and through which outside air is drawn into the outlet unit to mix with the ongoing current of hot air flowing out of the body exit.

2. The hair dryer of claim 1, wherein the outlet unit is composed of:

a rear housings; and a front housing, wherein the rear housing has:

a round portions; and a conical shell, with the round portion of the rear housing defining an entrance at a first rear end and formed with an inwardly annular wall at a first front end, with the conical shell extending from an inner edge of the inwardly annular wall of the round portion to a second front end and defining a shell exit at the second front end, with the conical shell gradually reduced in a first cross section extending towards the second front end, with the inwardly annular wall provided with an annular projection around the conical shell such that an annular surface is formed adjacently around the annular projection;

wherein the front housing has an outlet connection portion at a third rear end and defines the housing exit at a third front end, with the outlet connection portion of the front housing defining an opening, with the front housing gradually reduced in a second cross section extending from the third rear end to the third front end; and wherein the front housing is fitted around the conical shell of the rear housing to have the outlet connection portion snugly fit over the annular projection of the rear housing and abut the annular surface of the rear housing.

3. The hair dryer of claim 2, wherein the main body includes:

a left shell, a right shell, and an inner case sandwiched between the left shell and the right shell, with the inner case defining therein a first inner space for installing the fan unit and the heating unit, with the left shell combined with the right shell to form a body connection portion which defines the body exit.

4. The hair dryer of claim 3, wherein a first annular space is defined between the conical shell of the rear housing and the annular projection of the rear housing; wherein the rear housing defines therein a second inner space and is connected to the main body by the round portion snugly fitting over the body connection portion, and wherein the body connection portion of the main body abuts the inwardly annular wall of the rear housing.

5. The hair dryer of claim 3, wherein the air-guiding member has a number of blades which extend outwardly from a central common axis to the conical shell, with each blade having a first lateral edge and a second lateral edge, with the first lateral edges of the number of blades located at the central common axis, and with the second lateral edge joining with the conical shell; wherein the first and second lateral edges defines a twisted surface therebetween; wherein each blade has a front edge facing towards the shell exit of the rear housing and has a rear edge opposite to the front edge; and wherein the central common axis of the air-guiding member is coaxial with a central axis of the inner case sandwiched between the left and right shells of the main body.

6. The hair dryer of claim 5, wherein the second lateral edge and the rear edge of each blade of the air-guiding member intersect at a first point while the second lateral edge and the front edge of each blade of the air-guiding member intersect at a second point, wherein a first line is connected between the first point and the central common axis such that the first line has a shortest distance therebetween, wherein a second line is connected between the second point and the central common axis such that the second line has a shortest distance therebetween, wherein a length of the first line is greater than a length of the second line, wherein the central common axis and the second lateral edge of each blade of the air-guiding member defines the twisted surface therebetween, and wherein the first line and the second line are offset by an angle when viewed in a direction of the central common axis.

7. The hair dryer of claim 2, wherein a distance between the shell exit of the rear housing and the annular surface of the rear housing is L2, wherein a maximum distance between the plurality of air holes of the front housing and the opening of the front housing is L1, with L2 being greater than L1; wherein a second annular space is defined between the rear housing and the front housing; and wherein an air mixing zone is defined between the shell exit of the rear housing and the housing exit of the front housing.

8. The hair dryer of claim 1, wherein the main body includes a left shell, a right shell, and an inner case sandwiched between the left shell and the right shell, with each of the left and right shells of the main body defining a semicircular recess at an inner surface, near the body exit of the main body, and provided with a semicircular projection at the body exit of the main body, and wherein a step is formed between the semicircular projection and an outer surface of one of the left and right shells.

9. The hair dryer of claim 8, wherein the outlet unit is composed of a rear housing and a front housing, wherein the rear housing has a round portion and a conical shell extending from the round portion, with the air-guiding member having a plurality of twisted blades within the conical shell, with the rear housing connected to the left and right shells of the main body by fitting the round portion into the semicircular recesses of the left and right shells of the main body, with the front housing snugly fitted over the semicircular projections of the left and right shells of the main body to be in contact with the step.

* * * * *